US012312759B2

(12) United States Patent
Considine et al.

(10) Patent No.: US 12,312,759 B2
(45) Date of Patent: May 27, 2025

(54) SNOW PLOW ASSEMBLY WITH FLOATING A-FRAME

(71) Applicant: Buyers Products Company, Mentor, OH (US)

(72) Inventors: Anthony Considine, Mentor, OH (US); Scott Moorman, Concord Township, OH (US)

(73) Assignee: BUYERS PRODUCTS COMPANY, Mentor, OH (US)

( * ) Notice: Subject to any disclaimer, the term of this patent is extended or adjusted under 35 U.S.C. 154(b) by 866 days.

(21) Appl. No.: 17/482,790

(22) Filed: Sep. 23, 2021

(65) Prior Publication Data

US 2022/0090339 A1 Mar. 24, 2022

Related U.S. Application Data

(60) Provisional application No. 63/082,170, filed on Sep. 23, 2020.

(51) Int. Cl.
*E01H 5/06* (2006.01)

(52) U.S. Cl.
CPC ..... *E01H 5/062* (2013.01)

(58) Field of Classification Search
CPC ..... E02F 3/8157; E01H 5/062; E01H 5/063
USPC ..... 37/231, 232
See application file for complete search history.

(56) References Cited

U.S. PATENT DOCUMENTS 1,920,475 A 8/1933 Meyer
1,964,617 A 6/1934 Bird
4,281,847 A 8/1981 Robe
4,342,163 A 8/1982 Hoekstra
4,596,081 A 6/1986 DeBilly
5,148,617 A 9/1992 Feller
5,638,618 A 6/1997 Niemela
5,950,336 A 9/1999 Liebl
6,154,986 A 12/2000 Hadler
6,170,178 B1 1/2001 Christy
6,178,669 B1 1/2001 Quenzi
6,393,737 B2 5/2002 Quenzi
6,928,757 B2 8/2005 Bloxdorf et al.
7,089,692 B2 8/2006 Strait
7,491,027 B1 2/2009 Mcfarland
7,562,718 B1 7/2009 Moorman
7,588,092 B2 9/2009 Liebl
7,805,862 B2 10/2010 Osgood
(Continued)

*Primary Examiner* — Jamie L McGowan

(74) *Attorney, Agent, or Firm* — Emerson, Thomson & Bennett, LLC; Roger D. Emerson

(57) ABSTRACT

A snow plow assembly has a push frame, a lift frame, and a coupling configured to attach the push frame to a lift frame. The coupling attaches the left and right sides of the push frame to the corresponding left and right sides of the lift frame, and each coupling being independently vertically floatable to allow the push frame to float vertically relative to the lift frame, while also allowing the push frame to rotate relative to the lift frame to accommodate for irregular or uneven ground surfaces. The couplings each include a bearing block that extends through an opening in the push frame and a retaining member that extends through an opening in the bearing block for operatively coupling the push frame to the lift frame. The bearing block facilitates distribution of load between the push frame and retaining member to reduce wear on the push frame.

16 Claims, 9 Drawing Sheets

(56) References Cited

U.S. PATENT DOCUMENTS

| | | | | |
|---|---|---|---|---|
| 7,805,866 | B1 * | 10/2010 | Osgood | E02F 3/3604 37/444 |
| 8,850,724 | B2 | 10/2014 | Bloxdorf | |
| 10,119,233 | B2 * | 11/2018 | Holman | E01H 5/062 |
| 10,801,172 | B2 * | 10/2020 | Moorman | E01H 5/066 |
| 2007/0271828 | A1 | 11/2007 | Mishra | |
| 2008/0053673 | A1 | 3/2008 | Dilworth | |
| 2019/0257047 | A1 * | 8/2019 | Moorman | E01H 5/066 |

* cited by examiner

SNOW PLOW ASSEMBLY WITH FLOATING A-FRAME

CROSS-REFERENCE TO RELATED APPLICATIONS

This application claims the benefit of US provisional patent application Ser. No. 63/082,170, filed on Sep. 23, 2020, which is incorporated herein by reference.

I. BACKGROUND

A. Technical Field

This present invention pertains generally to the field of snow plows, and more particularly to snow plow assemblies having a floating A-frame.

B. Description of Related Art

Snow plow assemblies are used on commercial, residential, or all-purpose vehicles for the effective removal of snow from the ground. A typical snow plow assembly includes a mounting frame coupled to a moldboard assembly for plowing the snow, a push frame pivotably connected to the mounting frame for allowing lateral pivoting movement of the mounting frame and moldboard assembly, and a lift frame operatively coupled to the push frame for vertically raising or lowering the push frame and the mounting frame. During the use of such snow plow assemblies, the vehicle and/or snow plow assembly may travel over irregular or uneven ground surfaces, which may cause uneven removal of snow from the ground. In addition, the snow plow assembly may experience a significant amount of pushing and pulling force during normal use, which can cause a significant amount of stress and wear on the snow plow assembly.

II. SUMMARY

Provided in this disclosure is a snow plow assembly having a push frame, a lift frame, and at least one coupling that attaches the push frame to a lift frame. The coupling includes a bearing block that extends through an opening in the push frame, and a retaining member that extends through an opening in the bearing block for operatively coupling the push frame to the lift frame. The bearing block extending through the push frame facilitates distribution of load between the push frame and retaining member to reduce wear on the push frame. A pair of such couplings may attach respective left and right sides of the push frame to the corresponding left and right sides of the lift frame, and each coupling may be independently vertically floatable to allow the push frame to float vertically relative to the lift frame, while also allowing the push frame to rotate relative to the lift frame to accommodate for irregular or uneven ground surfaces. To promote such floating functionality, the respective bearing blocks may be vertically movable within the respective openings of the push frame.

According to an aspect, a snow plow assembly for a vehicle includes: a push frame to which a moldboard is mountable for enabling removal of snow; a lift frame configured for mounting to the vehicle; a lift device mounted to the lift frame, the lift device configured to vertically raise or lower the push frame and the moldboard relative to a horizontal plane; and a first coupling and a second coupling, the first coupling attaching a left side of the push frame to a corresponding left side of the lift frame, and the second coupling attaching a right side of the push frame to a corresponding right side of the lift frame; wherein the first and second couplings each include a bearing block that extends through a bearing block opening in the push frame, and wherein each bearing block includes a retainer opening that receives a retaining member that operatively couples the left and right sides of the push frame to the lift frame; and wherein the respective bearing blocks of the first and second couplings are configured to slidably move vertically within the respective bearing block openings when the snow plow assembly is in use to thereby allow each of the left and right sides of the push frame to float vertically relative to the respective left and right sides of the lift frame, and are configured to allow the left and right sides of the push frame to float vertically independently of one another, thereby allowing the push frame to rotate relative to the lift frame about a longitudinal axis extending in a forward direction, which enables the snow plow assembly to accommodate for irregular or uneven ground surfaces when the snow plow assembly is in use.

According to another aspect, a snow plow assembly for a vehicle includes: a push frame to which a moldboard is mountable for enabling removal of snow; a lift frame configured for mounting to the vehicle; a lift device mounted to the lift frame, the lift device configured to vertically raise or lower the push frame and the moldboard relative to a horizontal plane; and a coupling configured to couple the push frame to the lift frame, the coupling including a bearing block and a retaining member; wherein the retaining member is configured to operatively couple the push frame to the lift frame while permitting the push frame to float vertically relative to the lift frame, wherein the bearing block extends through an opening in the push frame and is interposed between the retaining member and the push frame, the bearing block being configured to distribute at least some load exerted on the push frame to the retaining member, thereby reducing wear on the push frame when the snow plow assembly is in use; and wherein the bearing block is at least partially interposed between the push frame and the retaining member in both a longitudinal rearward direction and a longitudinal forward direction to cause the retaining member to preferentially engage the bearing block, while restricting the retaining member from engaging the push frame, when the snow plow assembly is pushing or pulling snow.

The following description and the annexed drawings set forth certain illustrative embodiments of the invention. These embodiments are indicative, however, of but a few of the various ways in which the principles of the invention may be employed. Other objects, advantages and novel features according to aspects of the invention will become apparent from the following detailed description when considered in conjunction with the drawings.

III. BRIEF DESCRIPTION OF THE DRAWINGS

The disclosed snow plow may take physical form in certain parts and arrangement of parts, embodiments of which will be described in detail in this specification and illustrated in the accompanying drawings which form a part hereof and wherein.

IV. DETAILED DESCRIPTION

Figure 1:
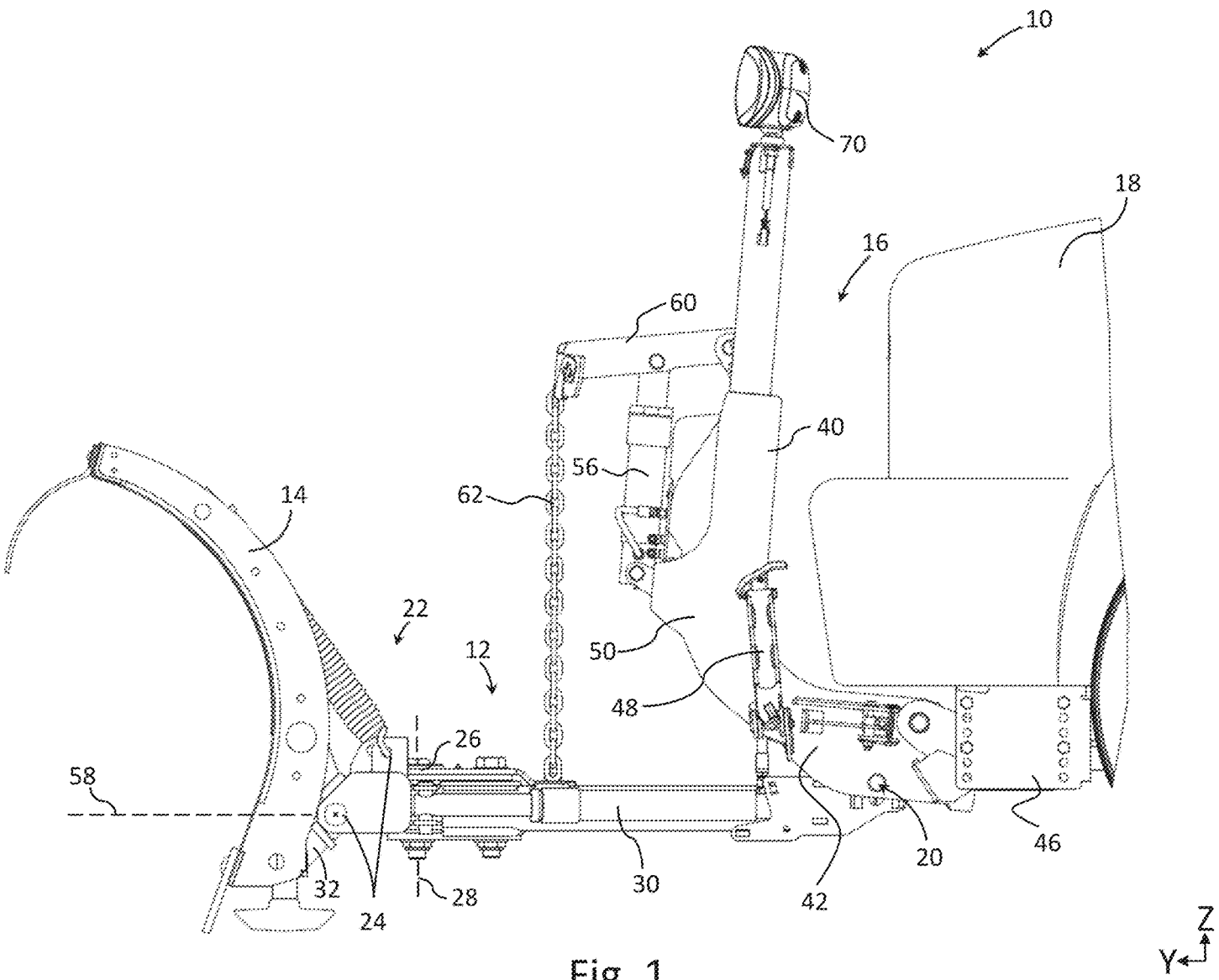
FIG. 1 is a side plan view of an exemplary snow plow assembly according to an exemplary embodiment.

Reference is now made to the drawings wherein the showings are for purposes of illustrating embodiments of the article only and not for purposes of limiting the same, and wherein like reference numerals are understood to refer to like components.

The principles of the present invention have particular application to snow plow assemblies for a vehicle, including commercial, residential, or all-purpose vehicles, and will be described below chiefly in this context. It is also understood, however, that the principles of the present invention may be applicable to other plow assemblies or vehicle-mounted accessories for other applications where it is desirable to provide one or more couplings that improve the load distribution on the push frame to reduce wear.

In the discussion above and to follow, the terms "upper", "lower", "top", "bottom," "inner," "outer," "left," "right," "above," "below," "horizontal," "vertical," etc. refer to the snow plow assembly as viewed in a horizontal position, as shown in FIG. 1, for example. As generally used herein, and unless otherwise provided in a different context, the terms forward and rearward are used synonymously with being in a longitudinal direction of the snow plow assembly, which is generally designated in the Y-direction in the figures; the terms left and right are used synonymously with being in a transverse or lateral direction, which is generally designated in the X-direction in the figures; and the terms upwards, downwards, vertical, or the like are used synonymously with being in a vertical direction, which is generally designated in the Z-direction in the figures. Furthermore, for the sake of clarity, the Y-direction has been oriented to point forward along a horizontal plane in the figures, the X-direction has been oriented to point left along the horizontal plane in the figures, and the Z-direction has been oriented to point upwards along a vertical plane in the figures. All of this is done realizing that such snow plow assemblies can be raised, lowered, inclined, declined, canted, etc., such as when being used on a vehicle.

Referring to FIGS. 1-7, an exemplary snow plow assembly 10 is shown.

The snow plow assembly 10 generally includes a push frame 12 to which a moldboard 14 is mountable for enabling removal of snow, and a lift frame 16 configured for mounting to a vehicle 18. As discussed in further detail below, the snow plow assembly 10 also includes one or more couplings 20 configured to attach the push frame 12 to the lift frame 16. The couplings 20 may floatably couple the push frame 12 to the lift frame 16, which may enable the snow plow assembly 10 to improve snow removal by accommodating for irregular or uneven ground surfaces encountered by the vehicle 18 and/or snow plow assembly 10 when in use. Also as discussed in further detail below, the one or more couplings 20 are configured to improve distribution of the loads exerted on portions of the push frame 12 to help reduce stress and wear.

In the illustrated embodiment of FIGS. 1-7, the snow plow assembly 10 includes a mounting bar 22 having one or more mounting interfaces 24, such as suitable brackets or the like, for operatively mounting the moldboard 14 to the push frame 12. As shown, the mounting bar 22 is pivotably connected to the push frame 12 via a suitable connection 26, such as via one or more brackets and bolts, for enabling lateral pivoting movement (e.g., left/right pivoting movement) of the mounting bar 22 relative to the push frame 12 about a vertical pivot axis 28. One or more pivot devices 30 may be connected to the left and/or right sides of the mounting bar 22, and connected to the left and/or right sides of the push frame 12, to enable the pivoting movement of the mounting bar 22 about the pivot axis 28. In the illustrated embodiment, the pivot devices 30 are fluid-operated piston-cylinder devices that may extend and retract to provide such pivoting movement to the mounting bar 22.

As shown in FIG. 1, the moldboard 14 may be any suitable type of moldboard or moldboard assembly, such as a straight moldboard, a V-shaped moldboard, or the like, and may have one or more plow blade edges for engaging the ground. The moldboard 14 may have corresponding mounting interfaces 32 for mounting to the mounting interfaces 24 of the mounting bar 22. It is understood that although the mount bar 22 is shown pivotably mounted to the push frame 12 for operatively coupling the moldboard 14, the moldboard 14 may be directly connected to the push frame 12, either removably or non-removably, and with or without pivoting movement, as may be desirable for particular applications.

Figure 4:
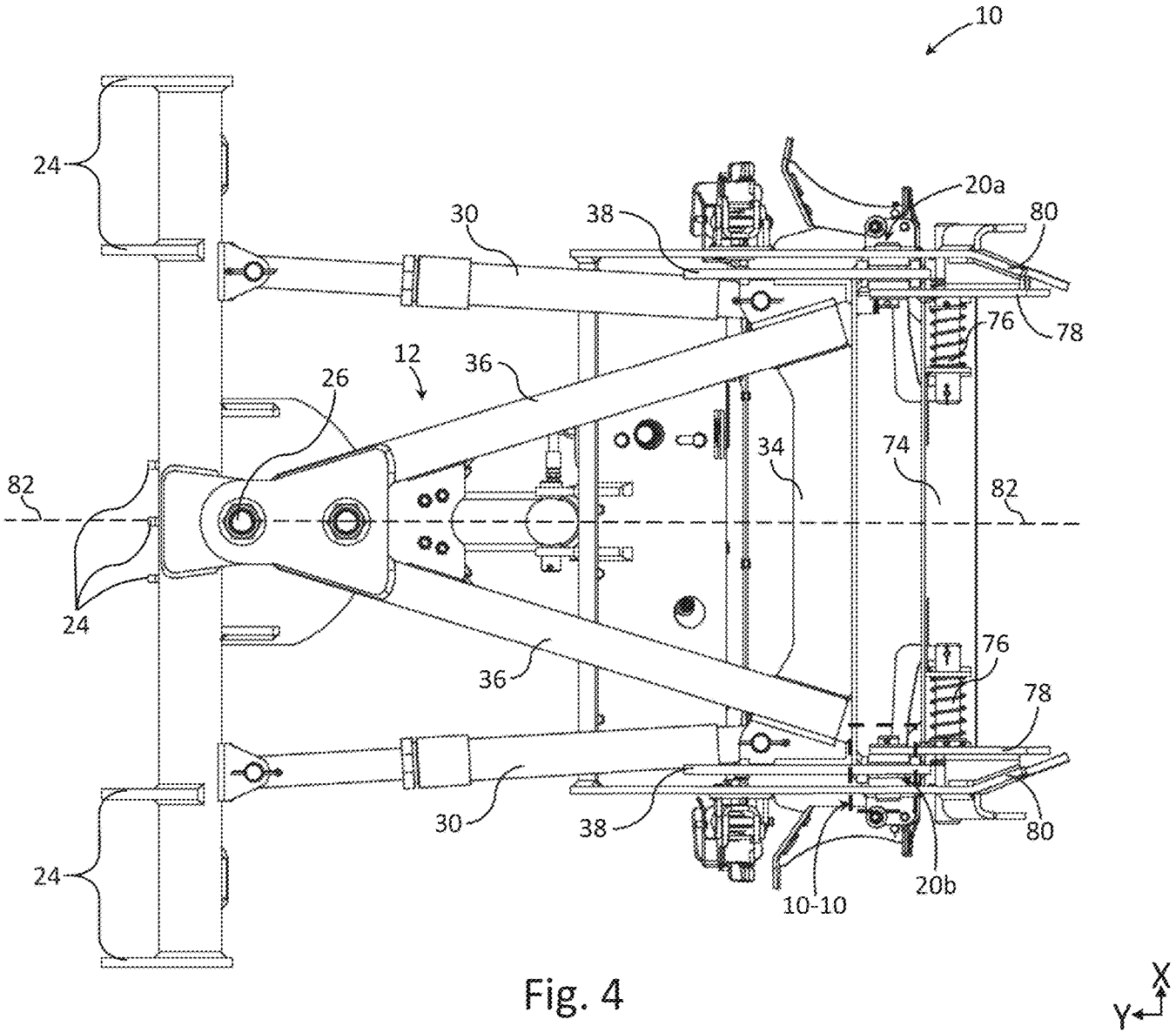
FIG. 4 is a bottom plan view of the snow plow assembly according to an exemplary embodiment.
Figure 5:
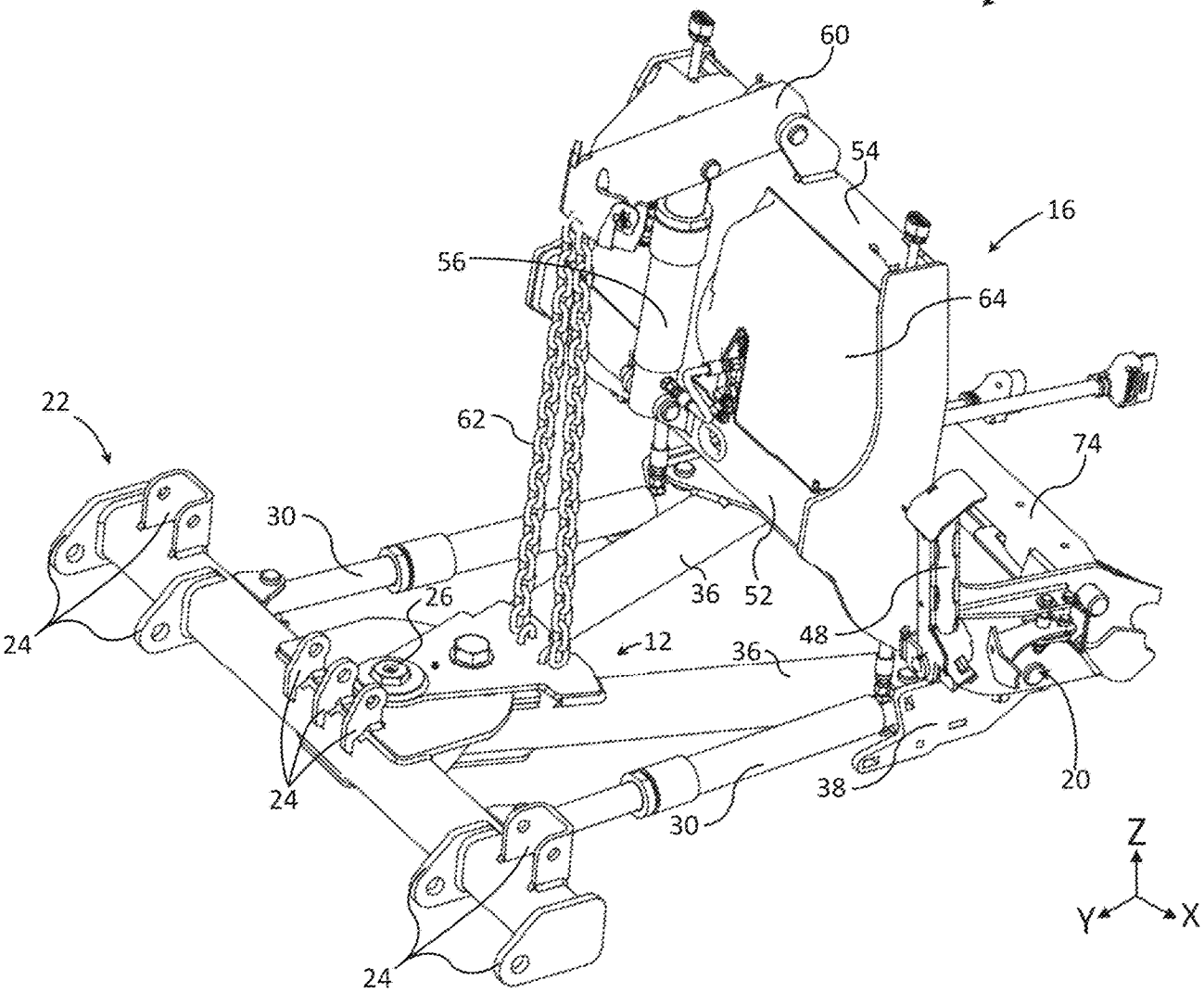
FIG. 5 is a front, top perspective view of the snow plow assembly according to an exemplary embodiment.
Figure 6:
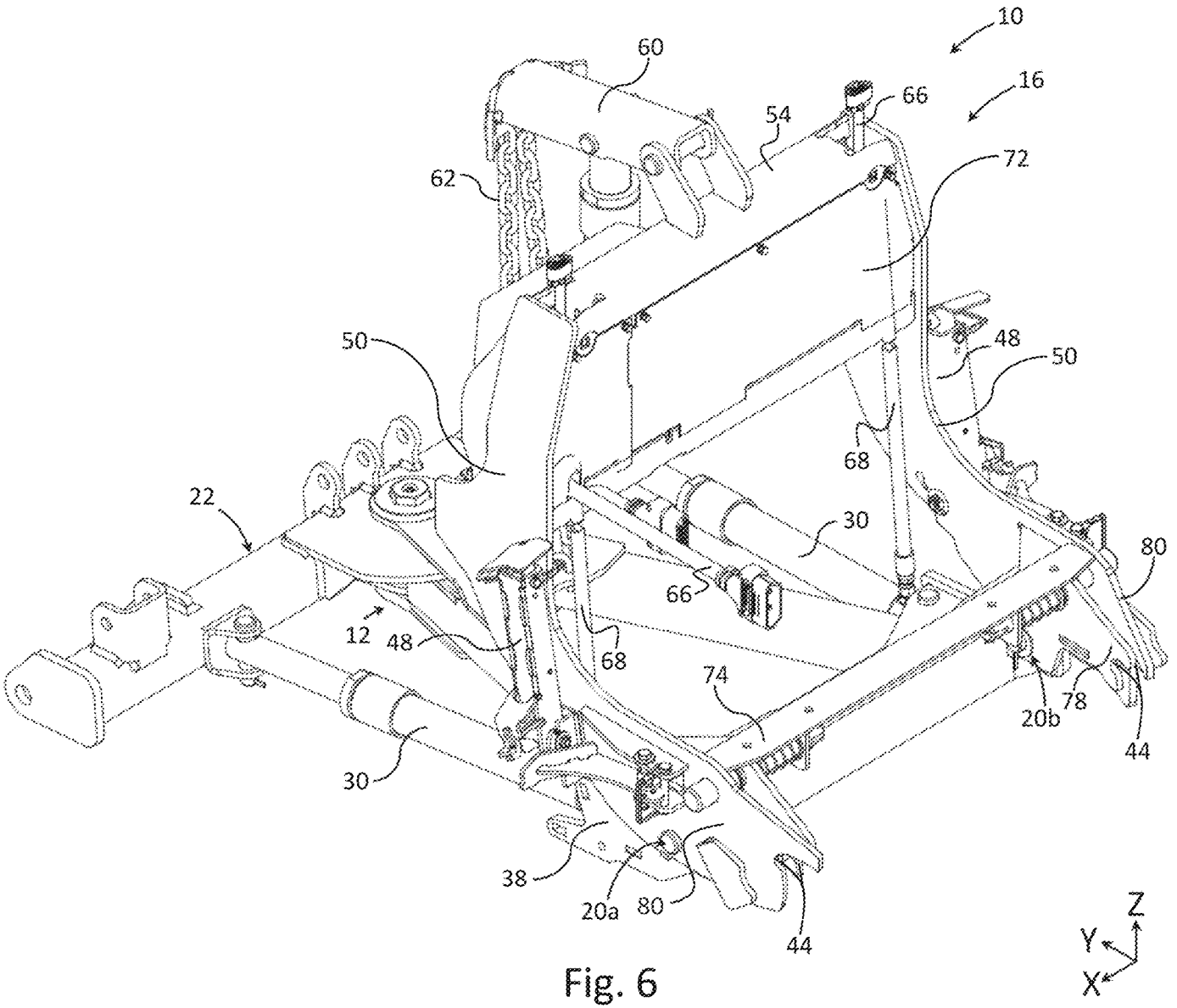
FIG. 6 is a rear, top perspective view of the snow plow assembly according to an exemplary embodiment.
Figure 7:
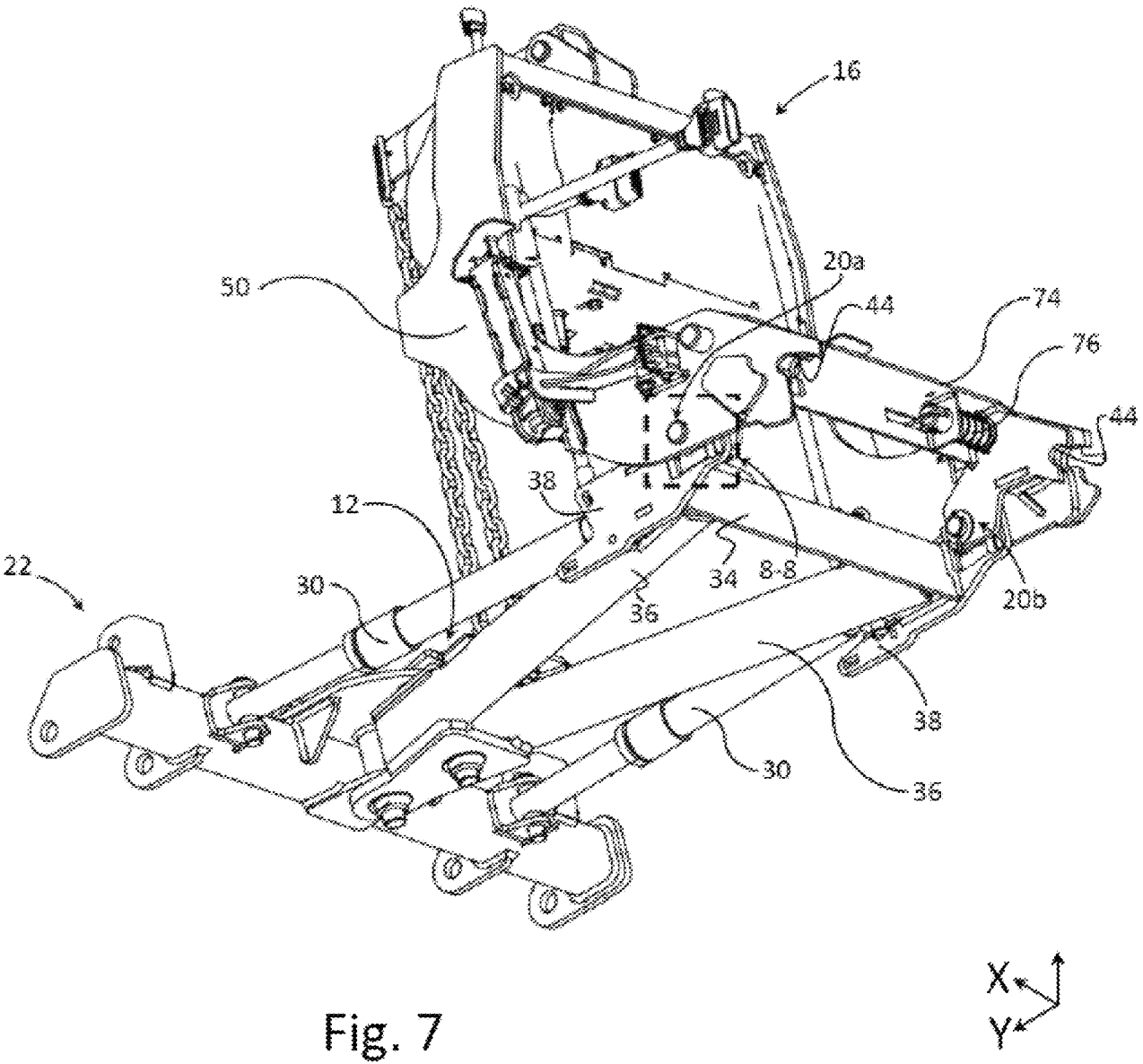
FIG. 7 is a rear, bottom perspective view of the snow plow assembly according to an exemplary embodiment.

In the illustrated embodiment, especially as shown in FIG. 4, the push frame 12 is configured as an A-frame having rear crossbar 34 and a pair of side bars 36 arranged in a triangular or "A" configuration. The side bars 36 converge in the forward direction to form a vertex portion of the push frame, which may include the interface 26 for pivotably mounting the mounting bar 22. The rear crossbar 34 extends in a transverse direction and is operatively connected to the side bars 36 via any suitable means, such as welding or fastening. The push frame 12 also includes a pair of rearwardly projecting left and right ears 38 (also referred to as rearward projections) that are connected to the lateral sides of the rear cross bar 34. It is understood that although the push frame 12 is shown as being a multiple component construction, one or more of the components of the push frame 12 shown in the illustrated embodiment may be integral and unitary with each other.

In the illustrated embodiment of FIGS. 1, 4, 5, 6, and 7, the lift frame 16 is generally vertically oriented and includes an upper portion 40 that extends upright above the push frame 12, and a lower portion 42 that is coupled to the push frame 12. The lower portion 42 also is operatively coupled to the vehicle 18. In the illustrated embodiment, the lower portion 42 of the lift frame 16 includes mounting hooks 44 for removably mounting the lift frame 16 to a mount frame 46 for quick secure attachment or removal of the plow assembly 10 without the use of tools. The mount frame 46 is operatively attached to the vehicle 18. The vehicle 18 may be any suitable vehicle, such as commercial, industrial, commuter, residential, or all-purpose vehicle. The mount frame 46 may be removably attached to the vehicle 18, or may be fixedly attached such as via welding to the vehicle frame in a manner well known in the art. The lift frame 16 also may include one or more stand assemblies 48 that are vertically pivotable downward to support at least a portion of the snow plow assembly 10, such as when the snow plow assembly 10 is detached from the vehicle 18. It is understood that although the lift frame 16 is shown as being removably mountable to a mount frame 46 via the hooks 44, the lift frame 16 could be directly removably mountable to the vehicle 18, or permanently attached to the vehicle 18, as may be desirable for particular applications.

With further reference to FIGS. 1, 4, 5, 6, and 7, the lift frame 16 includes a pair of vertical support members 50 that are transversely spaced apart frame one another. One or more transverse crossmembers 52, 54 may connect the vertical cross members 50 at the upper portion 40 of the lift frame 16. As shown, a lift device 56 is mounted to the lift frame 16 and is also operatively coupled to the push frame 12 such that activation of the lift device 56 vertically raises or lowers the push frame 12 and the moldboard 14 relative to a horizontal plane 58. In the illustrated embodiment, a forwardly extending lift arm 60 is operably coupled to one of the crossmembers 54, and a tether 62, such as a chain or other suitable linkage, operably connects the lift arm 16 to the push frame 12. The lift device 56 is coupled to the cross member 52 on one end of the lift device, and is connected to the lift arm 60 at the opposite end of the lift device 56. In the illustrated embodiment, the lift device 56 is a fluid operated piston-cylinder device in which extension or retraction of the device causes the lift arm 60 to pivot upwards or downwards relative to the crossmember 54 and the vertical support members 50, thereby causing the forward portion of the push frame 12 to raise or lower via the chain 62.

Figure 2:
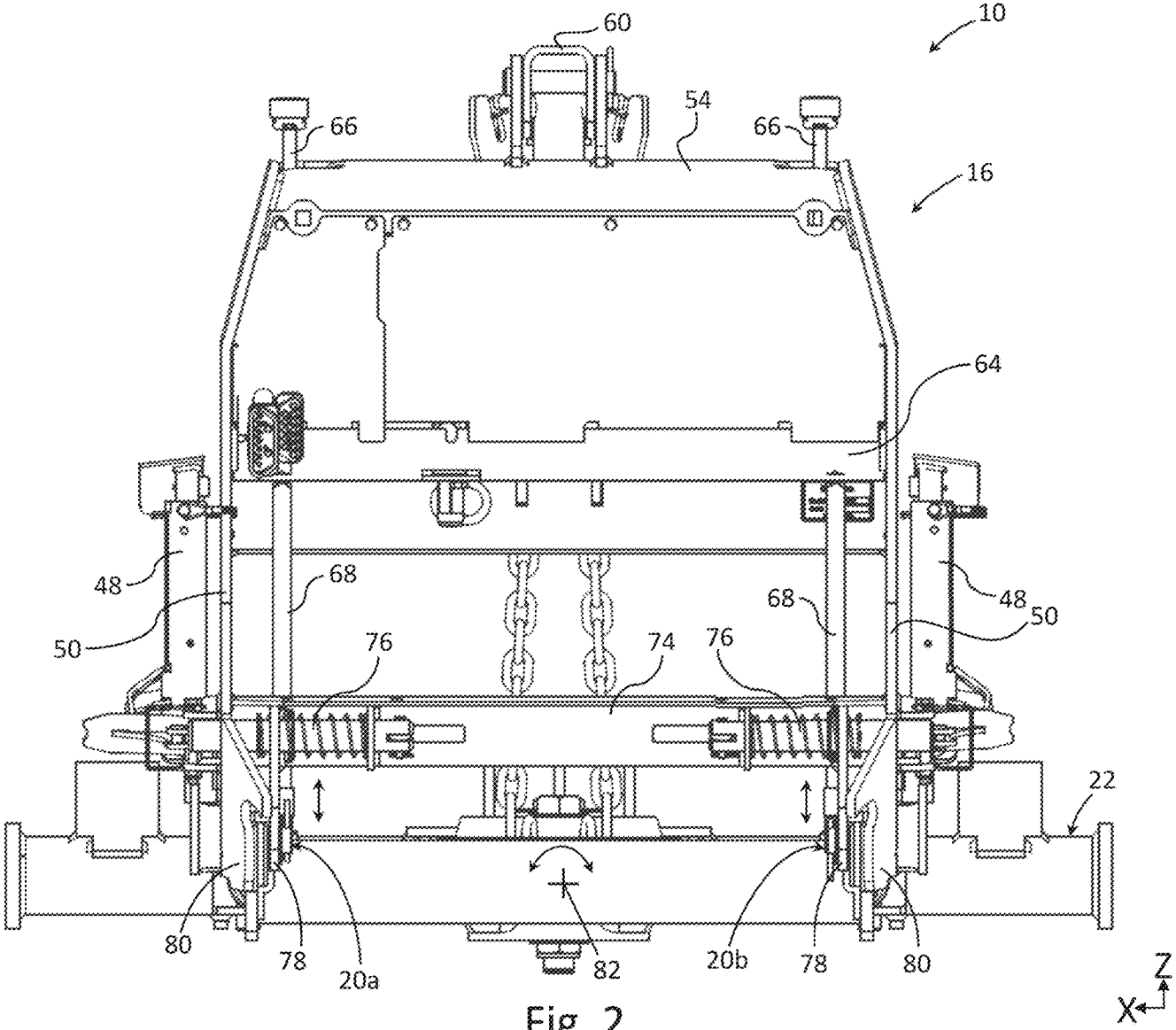
FIG. 2 is a rear plan view of the snow plow assembly according to an exemplary embodiment.
Figure 3:
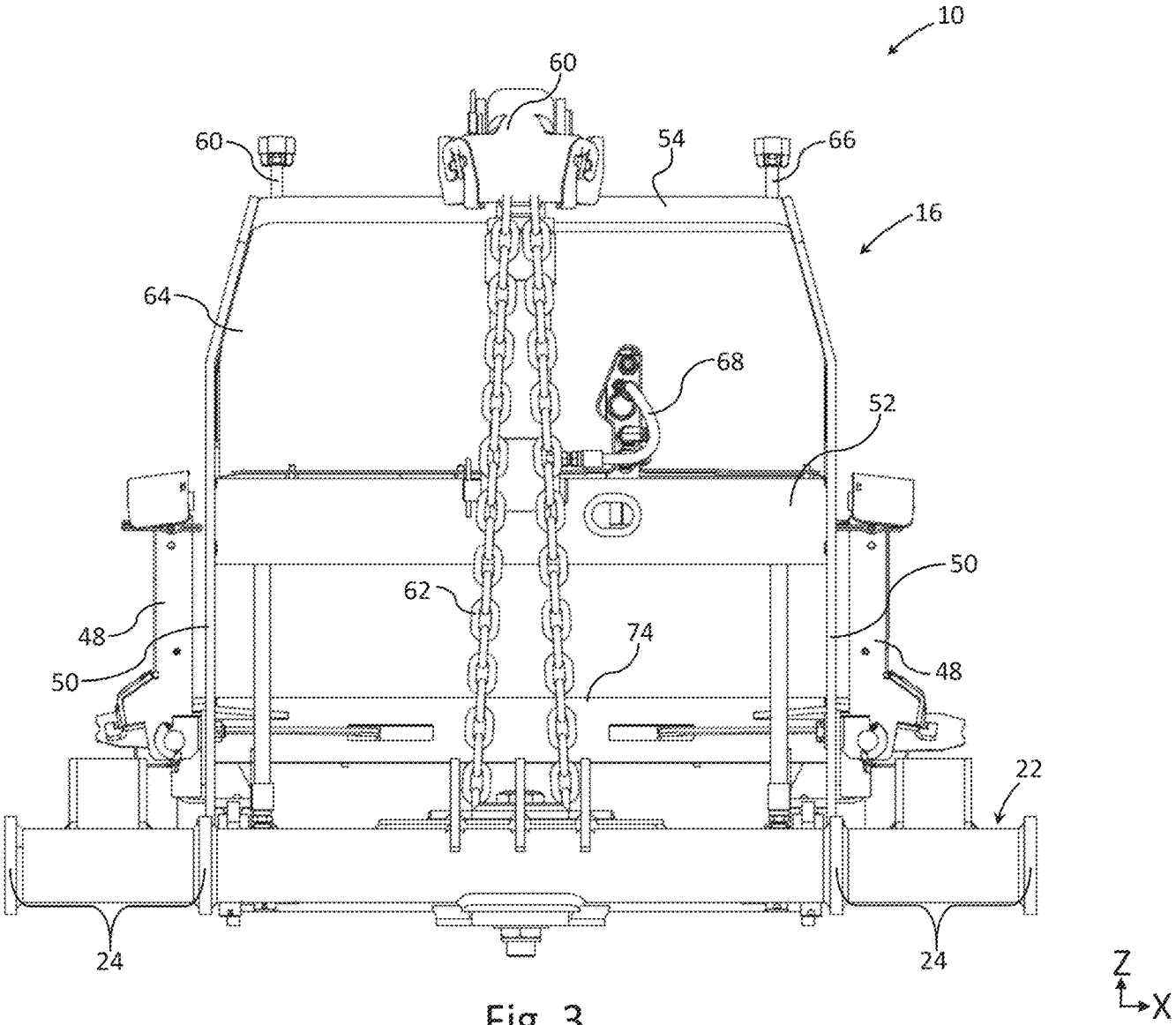
FIG. 3 is a front plan view of the snow plow assembly according to an exemplary embodiment.

As especially shown in FIGS. 2 and 3, the lift frame 16 also may include a housing 64 that spans the space between the vertical support members 50. The housing 64 may contain electronic and/or fluid (e.g., hydraulic) devices and may act as a shield to the snow. As shown, one or more electrical conduits 66 and/or one or more fluid conduits 68 may extend from the housing 64 to provide a source of power to one or more of the pivot devices 30, lift device 56, and/or lights 70 (shown in FIG. 1). The housing 64 may contain one or more access panels 72 for accessing the internal chamber of the housing 64.

With further reference to FIGS. 2 and 3, the lower portion of the lift frame 42 may include another crossmember 74 extending between the laterally spaced apart supports 50. One or more spring-loaded pins 76 for mounting the snow plow assembly. As shown, the lift frame 16 may include inner lift frame members 78 and outer lift frame portions 80. The inner lift frame members 78 may be configured to engage the respective springs of the spring-loaded pins 76. The inner lift frame members 78 and the outer lift frame portions 80 may each have the hooks 44 for removably mounting the lift frame 16 to the mounting frame 46, as discussed above. In addition, the inner lift frame members 78 and the outer lift frame portions 80 may cooperate with each other to couple the lift frame 16 to the push frame 12 via the couplings 20, as discussed in further detail below. It is understood that although the lift frame 16 is shown as being a multiple component construction, one or more of the components of the lift frame 16 shown in the illustrated embodiment may be integral and unitary with each other as may be desired.

Figure 8:
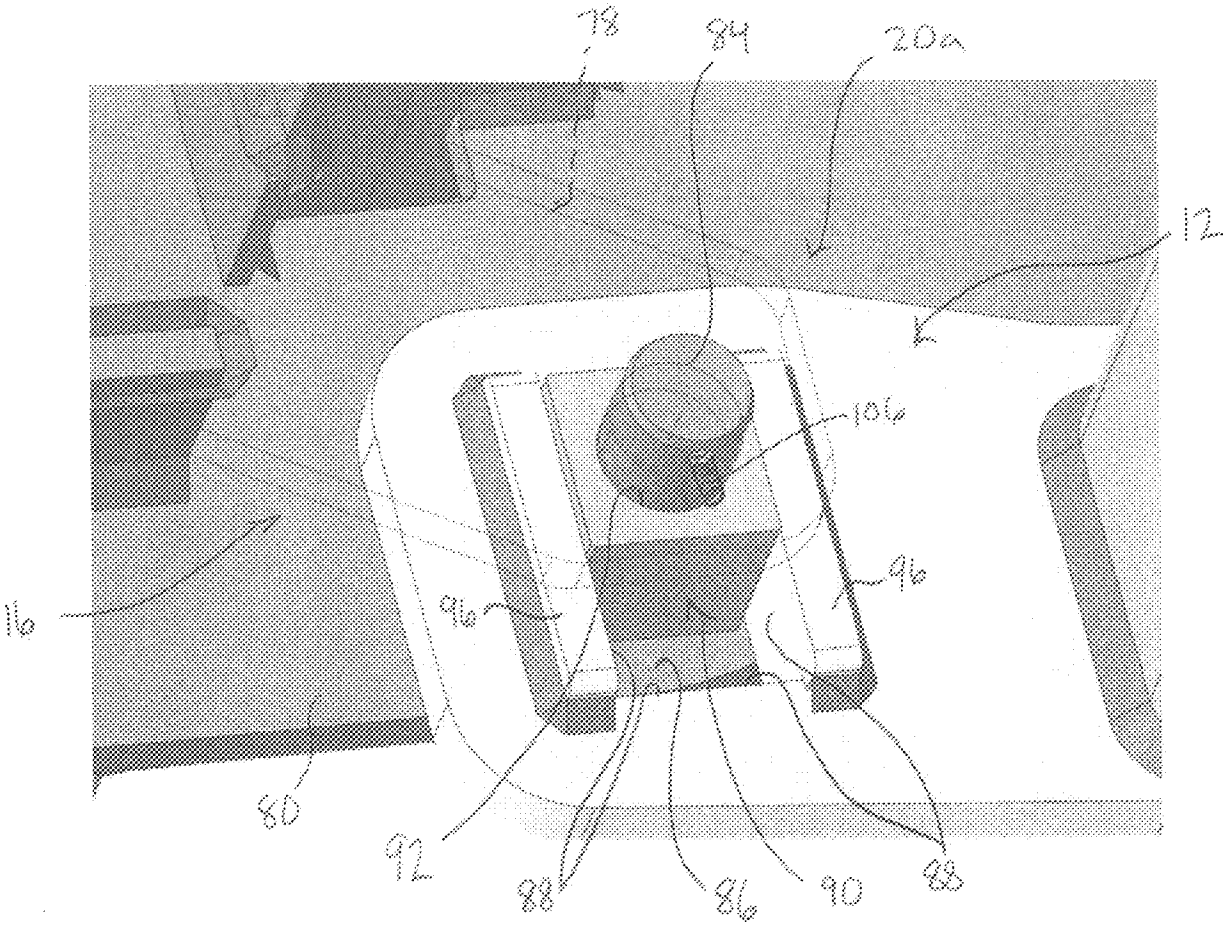
FIG. 8 is an enlarged bottom perspective view of section 8-8 in FIG. 7, which shows an exemplary coupling of the snow plow assembly, with an inner portion of the lift frame in transparent view according to an embodiment of the invention.
Figure 9:
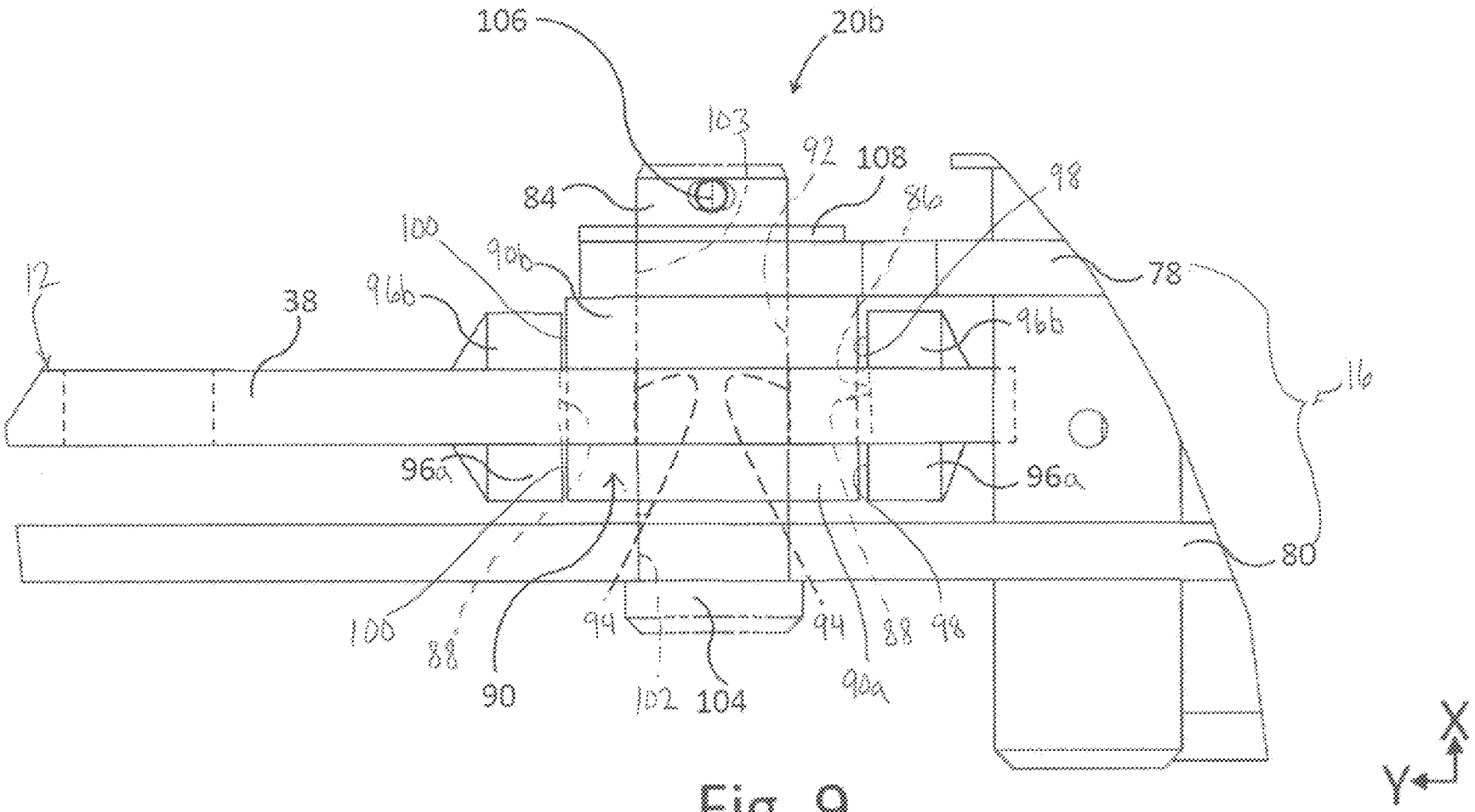
FIG. 9 is a cross-sectional top view of the coupling according to an embodiment of the invention.

Referring particularly to FIGS. 8 and 9, with reference to FIGS. 1-7, the coupling(s) 20 are shown in further detail. As shown, the snow plow assembly 10 may include first and second couplings 20*a* and 20*b* (collectively referred to herein as couplings 20), with the first coupling 20*a* attaching a left side of the push frame 12 to a corresponding left side of the lift frame 16, and the second coupling 20*b* attaching a right side of the push frame to a corresponding right side of the lift frame. As discussed above, the couplings 20*a* and 20*b* may be configured to allow each of the left and right sides of the push frame 12 to float vertically relative to the respective left and right sides of the lift frame 16 (as designated by the vertical arrows in FIG. 2 and FIG. 8). The couplings 20*a* and 20*b* also may be configured to allow the left and right sides of the push frame 12 to float vertically independently of one another. This independent floating movement of each of the couplings 20*a* and 20*b* allows the push frame 12 to rotate relative to the lift frame 16 about a longitudinal axis 82 (as designated by the arc-shaped double arrow in FIG. 2), which enables the snow plow assembly 10 to accommodate for irregular or uneven ground surfaces when the snow plow assembly is in use. As discussed in further detail below, the couplings 20 also are configured to facilitate distribution of pushing or pulling loads on the push frame 12 where high concentration of stresses are likely to occur, which allows the couplings 20 to help reduce wear on the push frame 12.

In the illustrated embodiment, particularly FIGS. 8 and 9, the couplings 20 each include a bearing block 90 that extends into an opening 86 in the push frame 12, and a retaining member 84 that extends into an opening 92 in the bearing block 90 for operatively coupling the push frame 12 to the lift frame 16. In this manner, the forces exerted on the push frame 12 are transferred to the bearing block 90 extending into the opening 86, and are then transferred through the bearing block 90 to the retaining member 84 and then to lift frame 16 which is operably supported by the vehicle 18.

As shown in FIGS. 8 and 9, the rearwardly extending portion 38 of the push frame 12 includes the bearing block opening 86 defined by inner surfaces 88 of the push frame 12. In the illustrated embodiment, the opening 86 is configured as an elongated through-opening 86 having a rectangular shape in cross-section for receiving a parallelepiped (e.g., cube, square cuboid, or rectangular cuboid) bearing block 90. The elongated opening 86 is configured to receive the bearing block 90 and allows the bearing block 90 to move vertically up and down within the opening 86 to permit the respective left and right sides of the push frame 12 to float vertically, and independently, relative to the corresponding left and right sides of the lift frame 16. The upper and lower portions of the inner surfaces 88 of the opening 86 may act as vertical stops that restrict the vertical floating movement of the bearing block 90.

In exemplary embodiments, especially FIGS. 8 and 9, the bearing block 90 extends into and through the opening 86 in the push frame 12 to improve distribution of load between the push frame 12 and retaining member 84 to reduce wear on the push frame 12. As shown, the bearing block 90 is at least partially interposed between the retaining member 84 and the push frame 12 in the forward and/or rearward longitudinal directions. In the illustrated embodiment, the retainer opening 92 in the bearing block 90 is configured as a through-hole 92 defined by inner surfaces 94 of the bearing block 90 which are configured to receive the retaining member 84 in the transverse direction. In this manner, the retaining member 84 may extend through the through-hole 92 in the bearing block 90 and extends within the bearing block 90 through the vertically elongated opening 86 of the push frame 12. Generally, the retaining member 84 may have a relatively tight fit with the inner surfaces 94 defining the through-hole 92 of the bearing block 90. This allows the retaining member 84 to move vertically together with the bearing block 90.

In exemplary embodiments, particularly FIGS. 8 and 9, the coupling 20 includes one or more longitudinally spaced apart and vertically extending stops 96 between which the bearing block 90 is disposed for engagement with the stops 96 when the pushing and pulling loads are exerted on the push frame 12. This enhances distribution of loads between the push frame 12 and the retaining member 84 by distributing the pushing and pulling loads exerted on the push frame 12 over a greater area for reducing wear on the push frame 12 and/or retaining member 84.

In the illustrated embodiment shown especially in FIGS. 8 and 9, the vertically elongated stops 96 include first stop portions 96*a* that protrude outwardly from an outer side of the push frame 12. In addition, the vertically elongated stops 96 may include second stop portions 96*b* that protrude inwardly from an inner side of the push frame 12. As shown, the respective first and second stop portions 96*a*, 96*b* may extend vertically along an entire length of the bearing block opening 86, and the bearing block 90 extends through the bearing block opening 86 to protrude inwardly and outwardly to slidably engage against both of the first and second stop portions 96*a*, 96*b*. Such a design greatly increases the surface area of engagement for improving distribution of load and reducing wear.

Generally, in the embodiment of FIGS. 8 and 9, to reduce the concentration of forces on portions of the push frame 12, the bearing surfaces 98 of the stops 96 which contact the bearing surfaces 100 of the bearing block 90, in combination with the bearing surfaces 88 of push frame 12 defining the through-opening 86, have a contact area that is greater than the area of contact between the bearing block(s) 90 and the retaining member 84. Because the bearing block 90 may be configured to take a higher concentration of the load in those locations where the bearing block 90 engages the retaining member 84 (e.g., at the inner surfaces 94 of the through-hole 92), the bearing block 90 may have an increased amount of wear compared to the engagement portions of the push frame 12 (e.g., the stops 96). The bearing block 90, however, may be a relatively inexpensive and easy to replace component compared to the push frame 12, and thus the bearing block 90 may be considered a sacrificial and replaceable wear block. In some embodiments, the stops 96 of the push frame also may be removably mountable to allow for replacement of the stops 96; however, it is also understood that the stops 96 may be fixedly attached to the rearward projections of the push frame 38, such as via welding or other suitable attachment.

In the illustrated embodiment, especially FIGS. 8 and 9, the retaining member 84 is configured to protrude outwardly of an outer portion 90*a* of the bearing block 90 and is configured to protrude inwardly of an inner portion 90*b* of the bearing block 90 to allow for connection to respective inner and/or outer portions of the lift frame 16. In the illustrated embodiment, the lift frame 16 forms a clevis with the inner lift frame member 78 (inner portion) and the outer lift frame portion 80, and each of the inner and outer portions of the lift frame have a through-hole 102, 103 through which the retaining member 84 extends for operatively coupling the push frame 12 to the lift frame 16. In the illustrated embodiment, the retaining member 84 is configured as a cylindrical pin having a head 104 on one end and a catch 106, such as a cotter pin, on the opposite end. The head 104 is sized greater than the size of the through hole 102 in the lift frame outer portion 80 to restrict too much inward lateral movement of the retaining member 84, and the catch 106, which may cooperate with a washer 108, may be configured to engage the inner portion 78 of the lift frame to restrict too much outward lateral movement of the retaining member 84. The retaining member 84 is preferably configured with a sufficient size and made of a suitable material to withstand the loads exerted on the pin without significant plastic deformation when the snow plow assembly is in use.

It is understood that although a preferred configuration of the exemplary snow plow assembly 10 including the floating coupling(s) 20 has been described and shown, it would be apparent to those having ordinary skill in the art that other push frame 12 and/or lift frame 16 designs could also be used with the present invention. The invention is not limited to any particular snow plow assembly design, but rather is appropriate for a wide variety of commercially-available snow plow assemblies. Furthermore, although the principles and aspects of the present invention have particular application to snow plow assemblies, it is understood that such principles and aspects may be applicable to other plow assemblies in general, or to other vehicle mounted or machine accessories upon which forces are exerted and which may be desirable to provide one or more floatable couplings that allow independent movement relative to each other and/or cooperate to provide rotational movement, and/or where it is desirable to provide one or more bearing blocks in the coupling to improve the load distribution, such as for vehicle-mounted rotating brushes, or the like.

It is furthermore understood that although a preferred exemplary embodiment of the coupling 20 has been shown and described, other suitable alternatives are possible. For example, although the retaining member 84 is shown as extending all the way through the opening 92 (configured as a through-hole) in the bearing block 90, the opening 92 could instead be configured as a blind-hole in the bearing block 90 within which an end of the retaining member 84 could be received without projecting therethrough. In such a configuration, two retaining members on opposite sides could be utilized for coupling the lift frame 16.

According to an aspect, a snow plow assembly for a vehicle, includes: a push frame to which a moldboard is mountable for enabling removal of snow; a lift frame configured for mounting to the vehicle; a lift device mounted to the lift frame, the lift device configured to vertically raise or lower the push frame and the moldboard relative to a horizontal plane; and a first coupling and a second coupling, the first coupling attaching a left side of the push frame to a corresponding left side of the lift frame, and the second coupling attaching a right side of the push frame to a corresponding right side of the lift frame; wherein the first and second couplings each include a bearing block that extends through a bearing block opening in the push frame, and wherein each bearing block includes a retainer opening that receives a retaining member that operatively couples the left and right sides of the push frame to the lift frame; and wherein the respective bearing blocks of the first and second couplings are configured to slidably move vertically within the respective bearing block openings when the snow plow assembly is in use to thereby allow each of the left and right sides of the push frame to float vertically relative to the respective left and right sides of the lift frame, and are configured to allow the left and right sides of the push frame to float vertically independently of one another, thereby allowing the push frame to rotate relative to the lift frame about a longitudinal axis extending in a forward direction, which enables the snow plow assembly to accommodate for irregular or uneven ground surfaces when the snow plow assembly is in use.

Embodiments may include one or more of the following additional features, separately or in any combination.

In some embodiments, wherein the retainer holes in the respective bearing blocks are adapted to fit the respective retaining members such that each retaining member moves vertically in conjunction with its respective bearing block.

In some embodiments, the respective bearing blocks are configured to distribute at least some load exerted on the push frame to the respective retaining members, thereby reducing wear on the push frame when the snow plow assembly is in use.

In some embodiments, the respective bearing block openings in the push frame have a rectangular shape in cross-section.

In some embodiments, the respective bearing blocks each have a parallelepiped form, and each bearing block extends through the respective openings such that each bearing block protrudes from opposite inner and outer sides of the push frame.

In some embodiments, each of the left and right sides of the push frame has at least one pair of vertically elongated stops spaced apart in the longitudinal forward direction on opposite sides of the bearing block opening.

In some embodiments, each bearing block extends through the bearing block opening in the push frame to slidably engage against the at least one pair of vertically elongated stops.

In some embodiments, each of the left and right sides of the push frame has a first pair of vertically elongated stops disposed on an inner side of the push frame, the first pair of stops being spaced apart from each other on opposite sides of the bearing block opening.

In some embodiments, each of the left and right sides of the push frame has a second pair of vertically elongated stops disposed on an outer side of the push frame, the second pair of stops being spaced apart from each other on opposite sides of the bearing block opening.

In some embodiments, the respective first and second pairs of vertically elongated stops extend vertically along an entire length of the bearing block opening.

In some embodiments, each bearing block extends through the bearing block opening in the push frame to slidably engage against both of the first and second pairs of vertically elongated stops.

In some embodiments, the respective retainer openings in each of the bearing blocks is a through-hole configured to receive the retaining member in a transverse horizontal direction that is transverse to the longitudinal forward direction.

In some embodiments, the retaining member is configured to extend through the through-hole in the bearing block.

In some embodiments, each retaining member extends in the transverse direction through the through-hole to protrude both outwardly and inwardly of a portion of the push frame.

In some embodiments, the lift frame is operatively coupled to a portion of the retaining member that protrudes outwardly of the portion of the push frame and/or is operatively coupled to a portion of the retaining member that protrudes inwardly of the portion of the push frame.

In some embodiments, only a single bearing block is provided through the bearing block opening in the respective left and right sides of the push frame.

In some embodiments, each of the left and right sides of the lift frame has an inner portion and an outer portion, the outer portion being spaced apart from the inner portion in the transverse horizontal direction.

In some embodiments, the outer portion of the lift frame is disposed outwardly of an outer portion of the bearing block, and the inner portion of the lift frame is disposed inwardly of an inner portion of the bearing block, such that a portion of the push frame and the inner and outer portion of the bearing block are transversely interposed between the inner and outer portions of the lift frame.

In some embodiments, the inner and outer portions of the lift frame each have a through-hole in alignment with the retainer opening in the bearing block.

In some embodiments, the retaining member extends through the retainer opening in the bearing block and through the respective openings in the inner and outer portions of the lift frame to couple the lift frame to the push frame.

In some embodiments, the push frame is configured as an A-frame having a forward vertex portion and transversely spaced apart left and right rearward portions.

In some embodiments, the forward vertex portion includes an interface for pivotably connecting a mounting bar to which the moldboard is mountable.

In some embodiments, the first and second couplings respectively connect the left and right rearward portions of the A-frame to the corresponding left and right sides of the lift frame.

In some embodiments, the snow plow assembly further includes one or more pivot devices connected to the push frame and the mounting bar for pivoting the mounting bar relative to the push frame.

In some embodiments, the lift frame has an upper portion that extends upright above the push frame, the upper portion having the lift device mounted thereon, and including a lift arm connected to the lift device, the lift arm having a tether connected to a forward end portion thereof, the tether being connected to a forward portion of the push frame such that extension of the lift device raises or lowers the push frame.

In some embodiments, the lift frame further includes one or more spring-loaded pins that are configured to permit transverse movement of the lift frame when the snow plow assembly is in use.

In some embodiments, the upper portion of the lift frame includes a pair of vertical support members, the vertical support members being transversely spaced apart frame one another, and the lift frame further including a housing that spans the space between the vertical support members.

According to another aspect, a snow plow assembly for a vehicle includes: a push frame to which a moldboard is mountable for enabling removal of snow; a lift frame configured for mounting to the vehicle; a lift device mounted to the lift frame, the lift device configured to vertically raise or lower the push frame and the moldboard relative to a horizontal plane; and a coupling configured to couple the push frame to the lift frame, the coupling including a bearing block and a retaining member; wherein the retaining member is configured to operatively couple the push frame to the lift frame while permitting the push frame to float vertically relative to the lift frame, wherein the bearing block extends through an opening in the push frame and is interposed between the retaining member and the push frame, the bearing block being configured to distribute at least some load exerted on the push frame to the retaining member, thereby reducing wear on the push frame when the snow plow assembly is in use, and; wherein the bearing block is at least partially interposed between the push frame and the retaining member in both a longitudinal rearward direction and a longitudinal forward direction to cause the retaining member to preferentially engage the bearing block, while restricting the retaining member from engaging the push frame, when the snow plow assembly is pushing or pulling snow.

Embodiments may include one or more of the following or foregoing additional features, separately or in any combination.

In some embodiments, the bearing block has forward and rearward outer bearing surfaces configured to engage corresponding forward and rearward portions of the push frame that define respective portions of the opening in the push frame, and has forward and rearward inner bearing surfaces configured to engage corresponding portions of the retaining member.

In some embodiments, a surface area of each of the forward and rearward outer bearing surfaces is greater than a surface area of each of the forward and rearward inner bearing surfaces for minimizing force concentration on the push frame, thereby limiting wear of the push frame and preferentially causing wear of the bearing block.

In some embodiments, the push frame further includes a first pair of vertically elongated stops disposed on an inner side of the push frame on opposite sides of the opening in the longitudinal forward direction, and further includes a second pair of vertically elongated stops disposed on an outer side of the push frame on opposite sides of the opening in the longitudinal forward direction.

In some embodiments, the bearing block extends through the opening and protrudes inwardly and outwardly of the push frame to engage against both the first and second pair of vertically elongated stops.

In some embodiments, the coupling is a first coupling for coupling a first side of the push frame to the lift frame, the snow plow assembly further including a second coupling for coupling a second side of the push frame to the lift frame.

In some embodiments, the second coupling including a second bearing block and a second retaining member, wherein the second bearing block extends through a second opening in the push frame and is interposed between the second retaining member and the second side of the push frame, the second bearing block being configured to distribute at least some load exerted on the push frame to the second retaining member, thereby reducing wear on the push frame when the snow plow assembly is in use.

In some embodiments, the second bearing block is at least partially interposed between the second side of the push frame and the second retaining member in both a longitudinal rearward direction and a longitudinal forward direction to cause the second retaining member to preferentially engage the second bearing block, while restricting the second retaining member from engaging the second side of the push frame, when the snow plow assembly is pushing or pulling snow.

As used herein, an "operable connection," or a connection by which entities are "operably connected," is one in which the entities are connected in such a way that the entities may perform as intended. An operable connection may be a direct connection or an indirect connection in which an intermediate entity or entities cooperate or otherwise are part of the connection or are in between the operably connected entities.

The phrase "and/or" should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified unless clearly indicated to the contrary. Thus, as a non-limiting example, a reference to "A and/or B," when used in conjunction with open-ended language such as "comprising" can refer, in one embodiment, to A without B (optionally including elements other than B); in another embodiment, to B without A (optionally including elements other than A); in yet another embodiment, to both A and B (optionally including other elements); etc.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed:

1. A snow plow assembly for a vehicle, the snow plow assembly comprising:

a push frame to which a moldboard is mountable for enabling removal of snow;

a lift frame configured for mounting to the vehicle;

a lift device mounted to the lift frame, the lift device configured to vertically raise or lower the push frame and the moldboard relative to a horizontal plane; and at least one coupling, attaching a side of the push frame to a corresponding side of the lift frame;

wherein the at least one coupling includes a bearing block that extends through a bearing block opening in the push frame, and wherein the bearing block includes a retainer opening that receives a retaining member that operatively couples the side of the push frame to the lift frame;

wherein the bearing block of the at least one coupling is configured to slidably move vertically within the bearing block opening when the snow plow assembly is in use to thereby allow the side of the push frame to float vertically relative to the side of the lift frame, and are configured to allow the side of the push frame to float vertically, thereby allowing the push frame to rotate relative to the lift frame about a longitudinal axis extending in a forward direction, which enables the snow plow assembly to accommodate for irregular or uneven ground surfaces when the snow plow assembly is in use;

wherein the side of the push frame has a first pair of vertically elongated stops disposed on an inner side of the push frame, the first pair of stops being spaced apart from each other on opposite sides of the bearing block opening;

wherein the side of the push frame has a second pair of vertically elongated stops disposed on an outer side of the push frame, the second pair of stops being spaced apart from each other on opposite sides of the bearing block opening;

wherein the respective first and second pairs of vertically elongated stops extend vertically along an entire length of the bearing block opening;

wherein the bearing block extends through the bearing block opening in the push frame to slidably engage against both of the first and second pairs of vertically elongated stops;

wherein the first and second vertically elongated stops each respectively include a first stop portion that protrudes outwardly from an outer side of the push frame, and a second stop portion that protrudes inwardly from an inner side of the push frame, such that the respective first and second stop portions extend vertically along an entire length of the bearing block opening, and the bearing block extends through the bearing block opening to protrude inwardly and outwardly to slidably engage against both of the first and second stop portions, thereby increasing surface area of engagement for improving distribution of load and reducing wear.

2. The snow plow assembly according to claim 1, wherein the retainer opening in the bearing block is adapted to fit the retaining member such that the retaining member moves vertically in conjunction with the bearing block.

3. The snow plow assembly according to claim 2, wherein the bearing block is configured to distribute at least some load exerted on the push frame to the retaining member, thereby reducing wear on the push frame when the snow plow assembly is in use.

4. The snow plow assembly according to claim 1, wherein the bearing block has a cross-section corresponding to the bearing block opening in the push frame, and wherein the bearing block extends through the bearing block opening such that the bearing block protrudes from opposite inner and outer sides of the push frame.

5. The snow plow assembly according to claim 1, wherein the retainer opening in the bearing block is a through-hole configured to receive the retaining member in a transverse horizontal direction that is transverse to the longitudinal forward direction; and wherein the retaining member is configured to extend through the through-hole in the bearing block.

6. The snow plow assembly according to claim 5, wherein each retaining member extends in the transverse direction through the through-hole to protrude both outwardly and inwardly of a portion of the push frame.

7. The snow plow assembly according to claim 6, wherein the lift frame is operatively coupled to a portion of the retaining member that protrudes outwardly of the portion of the push frame and/or is operatively coupled to a portion of the retaining member that protrudes inwardly of the portion of the push frame.

8. The snow plow assembly according to claim 1, wherein the at least one coupling is a first coupling for coupling a first side of the push frame to the lift frame, the snow plow assembly further including a second coupling for coupling a second side of the push frame to the lift frame, the second coupling including a second bearing block and a second retaining member;

wherein the second bearing block extends through a second opening in the push frame and is interposed between the second retaining member and the second side of the push frame, the second bearing block being configured to distribute at least some load exerted on the push frame to the second retaining member, thereby reducing wear on the push frame when the snow plow assembly is in use, and;

wherein the second bearing block is at least partially interposed between the second side of the push frame and the second retaining member in both a longitudinal rearward direction and a longitudinal forward direction to cause the second retaining member to preferentially engage the second bearing block, while restricting the second retaining member from engaging the second side of the push frame, when the snow plow assembly is pushing or pulling snow.

9. The snow plow assembly according to claim 1, wherein the side of the lift frame has an inner portion and an outer portion, the outer portion being spaced apart from the inner portion in the transverse horizontal direction;

wherein the outer portion of the lift frame is disposed outwardly of an outer portion of the bearing block, and the inner portion of the lift frame is disposed inwardly of an inner portion of the bearing block, such that a portion of the push frame and the inner and outer portion of the bearing block are transversely interposed between the inner and outer portions of the lift frame;

wherein the inner and outer portions of the lift frame each have a through-hole in alignment with the retainer opening in the bearing block; and wherein the retaining member extends through the retainer opening in the bearing block and through the respective openings in the inner and outer portions of the lift frame to couple the lift frame to the push frame.

10. The snow plow assembly according to claim 1, wherein the push frame is configured as an A-frame having a forward vertex portion and transversely spaced apart left and right rearward portions;

wherein the forward vertex portion includes an interface for pivotably connecting a mounting bar to which the moldboard is mountable; and wherein the at least one coupling connects a rearward portion of the A-frame to the corresponding side of the lift frame.

11. The snow plow assembly according to claim 10, wherein the snow plow assembly further includes one or more pivot devices connected to the push frame and the mounting bar for pivoting the mounting bar relative to the push frame.

12. The snow plow assembly according to claim 1, wherein the lift frame has an upper portion that extends upright above the push frame, the upper portion having the lift device mounted thereon, and including a lift arm connected to the lift device, the lift arm having a tether connected to a forward end portion thereof, the tether being connected to a forward portion of the push frame such that extension of the lift device raises or lowers the push frame.

13. The snow plow assembly according to claim 12, wherein the lift frame further includes one or more spring-loaded pins that are configured to permit transverse movement of the lift frame when the snow plow assembly is in use.

14. The snow plow assembly according to claim 12, wherein the upper portion of the lift frame includes a pair of vertical support members, the vertical support members being transversely spaced apart from one another, and the lift frame further including a housing that spans the space between the vertical support members.

15. A snow plow assembly for a vehicle, the snow plow assembly comprising:

a push frame to which a moldboard is mountable for enabling removal of snow;

a lift frame configured for mounting to the vehicle;

a lift device mounted to the lift frame, the lift device configured to vertically raise or lower the push frame and the moldboard relative to a horizontal plane; and a coupling configured to couple the push frame to the lift frame, the coupling including a bearing block and a retaining member;

wherein the retaining member is configured to operatively couple the push frame to the lift frame while permitting the push frame to float vertically relative to the lift frame, wherein the bearing block extends through a bearing block opening in the push frame and is interposed between the retaining member and the push frame, the bearing block being configured to distribute at least some load exerted on the push frame to the retaining member, thereby reducing wear on the push frame when the snow plow assembly is in use, and;

wherein the bearing block is at least partially interposed between the push frame and the retaining member in both a longitudinal rearward direction and a longitudinal forward direction to cause the retaining member to preferentially engage the bearing block, while restricting the retaining member from engaging the push frame, when the snow plow assembly is pushing or pulling snow;

wherein the bearing block has forward and rearward outer bearing surfaces configured to engage corresponding forward and rearward portions of the push frame that define respective portions of the bearing block opening in the push frame, and has forward and rearward inner bearing surfaces configured to engage corresponding portions of the retaining member; and wherein a surface area of each of the forward and rearward outer bearing surfaces is greater than a surface area of each of the forward and rearward inner bearing surfaces for minimizing force concentration on the push frame, thereby limiting wear of the push frame and preferentially causing wear of the bearing block;

wherein the push frame further includes a first pair of vertically elongated stops disposed on an inner side of the push frame on opposite sides of the bearing block opening in the longitudinal forward direction, and further includes a second pair of vertically elongated stops disposed on an outer side of the push frame on opposite sides of the bearing block opening in the longitudinal forward direction;

wherein the bearing block extends through the bearing block opening and protrudes inwardly and outwardly of the push frame to engage against both the first and second pair of vertically elongated stops;

wherein the first and second vertically elongated stops each respectively include a first stop portion that protrudes outwardly from an outer side of the push frame, and a second stop portion that protrudes inwardly from an inner side of the push frame, such that the respective first and second stop portions extend vertically along an entire length of the bearing block opening, and the bearing block extends through the bearing block opening to protrude inwardly and outwardly to slidably engage against both of the first and second stop portions, thereby increasing surface area of engagement for improving distribution of load and reducing wear.

16. The snow plow assembly according to claim 15, wherein the coupling is a first coupling for coupling a first side of the push frame to the lift frame, the snow plow assembly further including a second coupling for coupling a second side of the push frame to the lift frame, the second coupling including a second bearing block and a second retaining member;

wherein the second bearing block extends through a second opening in the push frame and is interposed between the second retaining member and the second side of the push frame, the second bearing block being configured to distribute at least some load exerted on the push frame to the second retaining member, thereby reducing wear on the push frame when the snow plow assembly is in use, and;

wherein the second bearing block is at least partially interposed between the second side of the push frame and the second retaining member in both a longitudinal rearward direction and a longitudinal forward direction to cause the second retaining member to preferentially engage the second bearing block, while restricting the second retaining member from engaging the second side of the push frame, when the snow plow assembly is pushing or pulling snow.

* * * * *